US008185032B2

(12) United States Patent
Ono et al.

(10) Patent No.: US 8,185,032 B2
(45) Date of Patent: May 22, 2012

(54) USED TONER COLLECTION DEVICE AND IMAGE FORMING APPARATUS

(75) Inventors: Hiroshi Ono, Tokyo (JP); Tokuya Ojimi, Kawasaki (JP); Shuji Tanaka, Chigasaki (JP); Ken Amemiya, Tokyo (JP); Toshio Koike, Kawasaki (JP); Yuji Arai, Kawasaki (JP); Michiya Okamoto, Zama (JP); Hiroyuki Nagashima, Yokohama (JP); Nobuo Kuwabara, Yokohama (JP); Masahiko Shakuto, Zama (JP)

(73) Assignee: Ricoh Company, Limited, Tokyo (JP)

( * ) Notice: Subject to any disclaimer, the term of this patent is extended or adjusted under 35 U.S.C. 154(b) by 1062 days.

(21) Appl. No.: 12/046,827

(22) Filed: Mar. 12, 2008

(65) Prior Publication Data

US 2008/0226333 A1 Sep. 18, 2008

(30) Foreign Application Priority Data

Mar. 13, 2007 (JP) ..... 2007-064155

(51) Int. Cl.
*G03G 21/00* (2006.01)
*G03G 21/12* (2006.01)

(52) U.S. Cl. ..... 399/358; 399/359; 399/360

(58) Field of Classification Search ..... 399/358–360
See application file for complete search history.

(56) References Cited

U.S. PATENT DOCUMENTS

| | | | | |
|---|---|---|---|---|
| 6,526,252 | B1 * | 2/2003 | Itoh et al. | 399/359 |
| 6,615,013 | B2 | 9/2003 | Arai et al. | |
| 6,829,461 | B2 | 12/2004 | Arai et al. | |
| 6,961,530 | B2 | 11/2005 | Arai et al. | |
| 7,120,366 | B2 * | 10/2006 | Onodera et al. | 399/35 |
| 7,142,791 | B2 * | 11/2006 | Yuge | 399/44 |
| 7,664,431 | B2 * | 2/2010 | Jang et al. | 399/167 |
| 2003/0219291 | A1 * | 11/2003 | Tokimatsu et al. | 399/359 |
| 2007/0172273 | A1 | 7/2007 | Harada et al. | |
| 2007/0209877 | A1 | 9/2007 | Arai et al. | |

FOREIGN PATENT DOCUMENTS

| | | |
|---|---|---|
| JP | 52-127337 | 10/1977 |
| JP | 61-186980 | 8/1986 |
| JP | 6-110329 | 4/1994 |
| JP | 8-115032 | 5/1996 |
| JP | 9-138579 | 5/1997 |
| JP | 3327380 | 7/2002 |

* cited by examiner

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

A used toner conveyance device includes a lateral conveyance member for conveying used toner substantially in the horizontal direction, and a vertical conveyance member for upwardly conveying the used toner transferred from the lateral conveyance member. The vertical conveyance member transfers the used toner to either a collection space or a next conveyance path. The vertical conveyance member stops its operation when a prescribed delay time has elapsed after the lateral conveyance member stops conveyance operation.

5 Claims, 3 Drawing Sheets

USED TONER COLLECTION DEVICE AND IMAGE FORMING APPARATUS

CROSS REFERENCE TO RELATED APPLICATION

This application claims priority under 35 USC §119 to Japanese Patent Application No. 2007-064155, filed on Mar. 13, 2007, the entire contents of which are herein incorporated by reference.

BACKGROUND OF THE INVENTION

1. Field of the Invention

The present invention relates to a used toner collection device and an image forming apparatus employing the used toner collection device.

2. Discussion of the Background Art

Conventionally, in an image forming apparatus, toner collected by a drum cleaner is conveyed and stored in a collection space arranged at an upper section in an all-in-one unit (including a photosensitive drum and peripherals including a toner tank) so as to downsize and save space. Further, as a conveyance system conveying used toner upward, a belt system is sometimes employed and is driven by a driving device for driving the drum cleaner. Various propositions have been presented as to a used toner collection technology as discussed in Japanese Patent Registration Nos. 3592068 and 3327380, and Japanese Patent Application Laid Open Nos. 9-138579, 9-120242, and 8-115032. In many of these conventional technologies, used toner is transferred from a cleaning device to a conveyance belt, and the conveyance belt moves it upward and passes the used toner to the collection space.

In the above-mentioned system, toner is firmly fixed or becomes massed together on the conveyance member due to temperature increase or the like, thereby likely deteriorating a conveyance performance. Further, the used toner remains, becomes massed together, and firmly sticks onto the vertical conveyance member, and thereby possibly deteriorating a conveyance performance in the worst case when an operation of the vertical conveyance member halts.

SUMMARY OF THE INVENTION

The present invention has been made in view of the above noted and another problems and one object of the present invention is to provide a new and noble used toner conveyance device.

Such a new and noble used toner conveyance device includes a lateral conveyance member for conveying used toner substantially in the horizontal direction, and a vertical conveyance member for upwardly conveying the used toner transferred from the lateral conveyance member. The vertical conveyance member transfers the used toner to either a collection space or a next conveyance path. The vertical conveyance member stops its operation when a prescribed delay time has elapsed after the lateral conveyance member stops conveyance operation.

In another embodiment, the used toner can be conveyed during the prescribed delay time from a used toner transfer section, at which the used toner is transferred from the lateral conveyance member to the vertical conveyance member, to another used toner transfer section, at which the used toner is transferred from the vertical conveyance member to one of the collection space and the next conveyance path.

In yet another embodiment, a conveyance speed of the vertical conveyance member is slower during the prescribed delay time than that during an ordinary operation.

In yet another embodiment, a driving force accumulation mechanism is provided to accumulate a driving force driving the lateral conveyance member. A driving force is applied from the driving force accumulation mechanism to the vertical conveyance member during the prescribed delay time.

In yet another embodiment, the vertical conveyance member gradually increases its conveyance speed after starting up, while the driving force driving the lateral conveyance member is accumulated at the same time in the driving force accumulation mechanism.

In yet another embodiment, the vertical conveyance member is forcibly stopped or interrupted when a door covering the vertical conveyance member is open during the prescribed delay time.

In yet another embodiment, toner having a low melting point is used.

In yet another embodiment, polymerized toner is used.

In yet another embodiment, a processing cartridge or an image forming apparatus includes the used toner conveyance device.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENT OF THE PRESENT INVENTION

Figure 1:
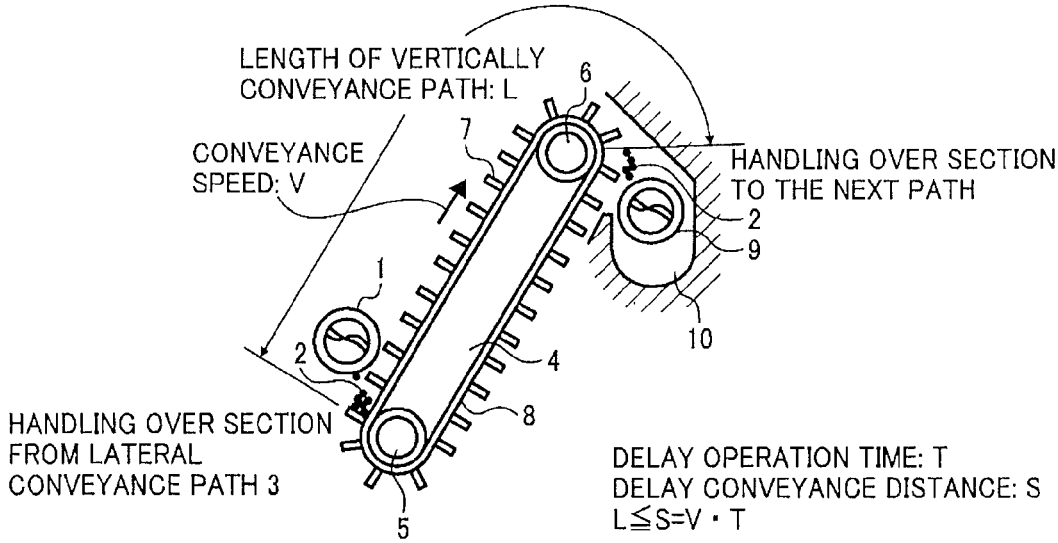
FIG. 1 illustrates an exemplary used toner collection device according to one embodiment of the present invention.

Referring now to the drawings, wherein like reference numerals and marks designate identical or corresponding parts throughout several figures, in particular In FIG. 1, used toner 2 is substantially horizontally conveyed from a lateral conveyance path 1 (e.g. a cleaning device), and is passed to a vertical conveyance path 4 from a transfer section 3.

The vertical conveyance path 4 includes a conveyance belt 8 rotating around a pair of rollers 5 and 6 with plural protrusions 7. The used toner 2 passed to the vertical conveyance path 4 is upwardly conveyed by the conveyance belt 8, and is further passed to either a collection space or the next path 10 from a transfer section 9.

In this embodiment, the vertical conveyance member 8 stops with a prescribed delay after the lateral conveyance path 1 stops supplying the used toner 2 from the lateral conveyance path 1 to the vertical conveyance path 4. Thus, since the vertical conveyance member 8 operates even after the lateral conveyance path 1 stops, toner remaining on the vertical conveyance member 8 can be decreased, and fixation and aggregation can be prevented. Further, the used toner can be credibly conveyed even after the path is left unused for a long time period and then restarts.

Figure 2:
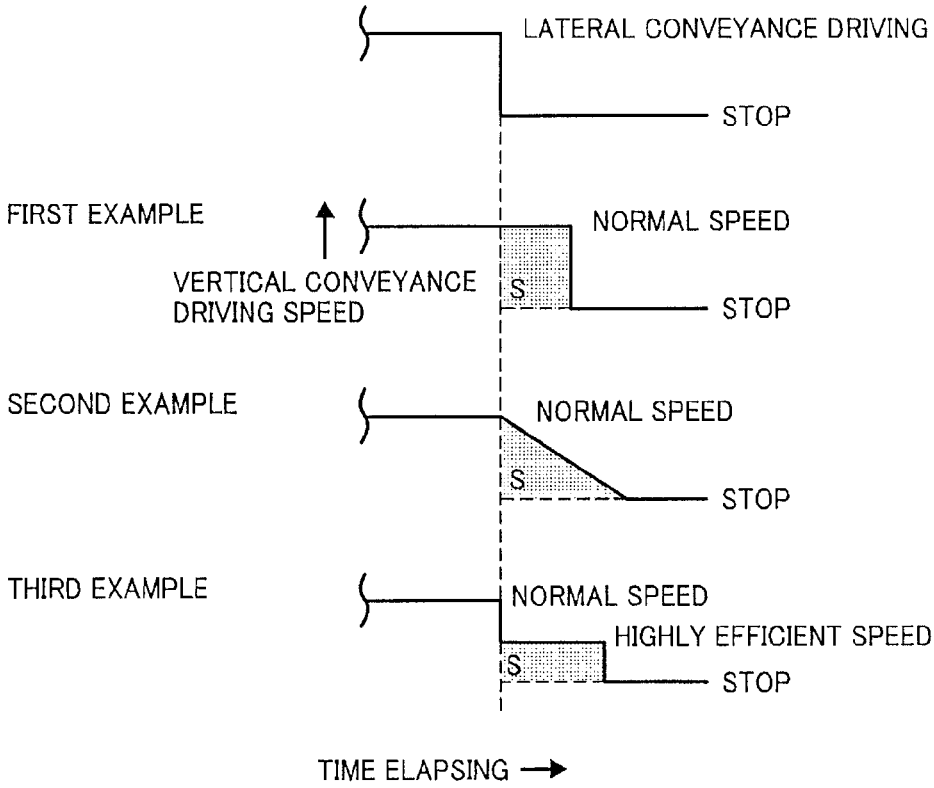
FIG. 2 illustrates an exemplary sequence of operations of lateral and vertical conveyance according to one embodiment of the present invention.

Now, an exemplary sequence of operations of the lateral and the vertical conveyance paths 1 and 4 is described with reference to FIG. 2. In a first example, the vertical conveyance member 8 operates at a normal speed and then stops with a prescribed delay when the lateral conveyance path 1 stops supplying the used toner thereto. In such a situation, an area S with gray can represent a distance of conveyance of the belt during the prescribed delay. In the second example, in which a speed of the vertical conveyance member 8 gradually decreases after the lateral conveyance path 1 stops, another area S represents the other delay conveyance distance. In the third example, a speed of the vertical conveyance member 8 decreases less than the normal one and the vertical conveyance member 8 stops when a prescribed time period has elapsed after the lateral conveyance path 1 stops. In this situation, still another area S represents still the other delay conveyance distance. A highly efficient conveyance speed is preferably selected in the third example.

Now, a second embodiment is described. The second embodiment is based on the first embodiment of FIG. 1, and is further characterized as follows. Specifically, as described with reference to FIG. 1, the prescribed delay enables the vertical conveyance member 8 to operate and convey the used toner to the transfer section 9 after receiving thereof from the lateral conveyance path 1.

According to this embodiment, since such conveyance is executed from an input position to an output position (i.e., between the transfer sections 3 and 9) during the prescribed delay, the less toner remains on the vertical conveyance member 8. As a result, the used toner can be prevented from fixation and aggregation, and is more credibly conveyed after the path 4 is left unused for a long time period.

When L represents a distance from the inlet to the outlet of the vertical conveyance path 4, the following relation is preferably satisfied:

$$L \leqq S$$

Further, a conveyance performance can especially be improved if a conveyance speed is decreased as mentioned with reference to the second and third examples of FIG. 2 as mentioned later in detail.

Now, a third embodiment is described. In this embodiment, as shown in the second and third examples of FIG. 2, the vertical conveyance member 8 operates slower than the ordinal speed during the delay in stopping after the lateral conveyance path 1 stops.

An amount of conveyable toner per hour is in proportion to an operation speed of a conveyance path. That is, the more the speed, the more the amount of conveyable toner. However, due to thrusting resistance created between a conveyance belt and a side wall or toner leakage and the like, each caused when the speed increases, an amount of actually conveyable toner (i.e., a conveyance efficiency) likely decreases in relation to a moving distance of the conveyance belt.

According to this embodiment, since the used toner to the conveyance member 8 is stopped inputting during the prescribed delay, there is no limitation to a conveyance amount per hour for the vertical conveyance member 8. Thus, if used toner is conveyed by the vertical conveyance member 8 at a highly efficient speed, toner remaining on the conveyance path can be reduced efficiently, and is credibly conveyed after a long halt.

Now, a fourth embodiment is described. This embodiment is based on the one of first to third embodiments. Specifically, a driving force for the vertical conveyance member 8 during the prescribed delay time is obtained from a driving source for driving the lateral conveyance path 1 via a driving force accumulation mechanism. Specifically, a driving force for driving the vertical conveyance member 8 during the prescribed delay is obtained from the driving force accumulation mechanism. For example, a spiral spring or a flywheel can be used as the driving force accumulation mechanism.

Figure 3:
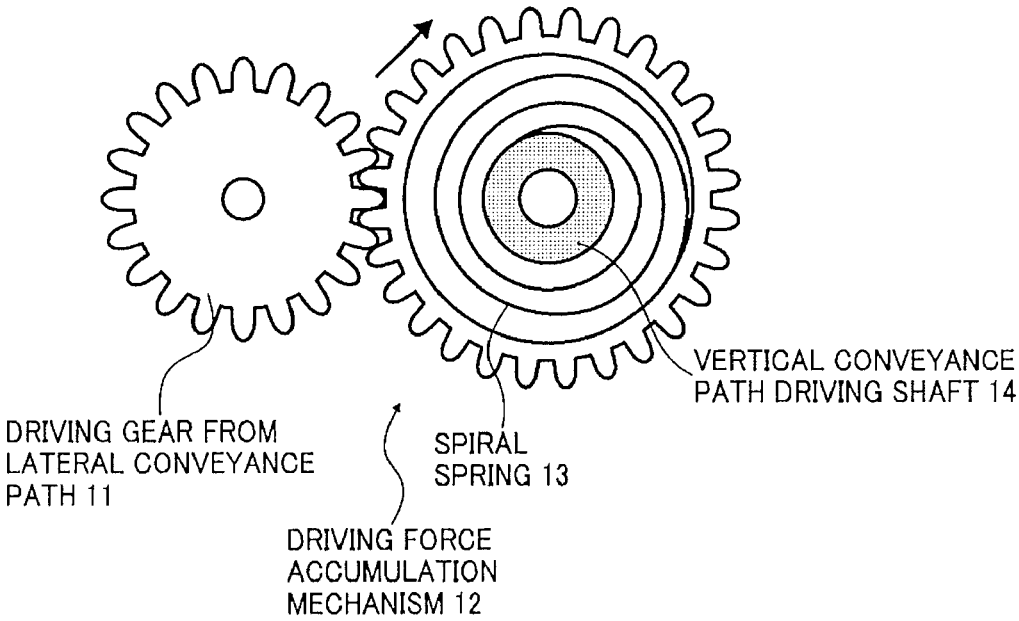
FIG. 3 illustrates an exemplary driving force accumulation mechanism according to one embodiment of the present invention.

An exemplary configuration of the driving force accumulation mechanism 12 with a built-in spiral spring is described with reference to FIG. 3. As shown, a driving force input from the lateral conveyance path to the driving force accumulation mechanism 12 via the driving gear 11 is temporarily used to wind up the spiral spring 13. Thus, the driving force for the vertical conveyance member 8 is accumulated. After a prescribed amount is accumulated, the driving force is transmitted to a vertical conveyance driving shaft 12.

According to this embodiment, an operation of the vertical conveyance path during the prescribed delay is achieved at low cost without a special driving source for vertical conveyance path private use, such as a motor, etc.

Now, a fifth embodiment is described. This embodiment is based on one of the first to fourth embodiments. Further, a driving force for the vertical conveyance member 8 is obtained from a driving source for driving the lateral conveyance path 1 via the above-mentioned driving force accumulation mechanism 12. The vertical conveyance member 8 gradually increases its traveling a speed after starting up while a driving force is accumulated in the driving force accumulation mechanism 12 until the vertical conveyance belt 8 reaches a normal speed.

According to this embodiment, when the driving force is accumulated, an amount of toner conveyed by the vertical conveyance member 8 becomes less than that conveyed by the lateral conveyance path 1. However, since an amount of the used toner on the vertical conveyance member 8 is more decreased than that is the first to fourth embodiments, the used toner almost does not pile up nor is aggregated. Thus, the driving force can be accumulated in the driving force accumulation mechanism 12.

Figure 4:
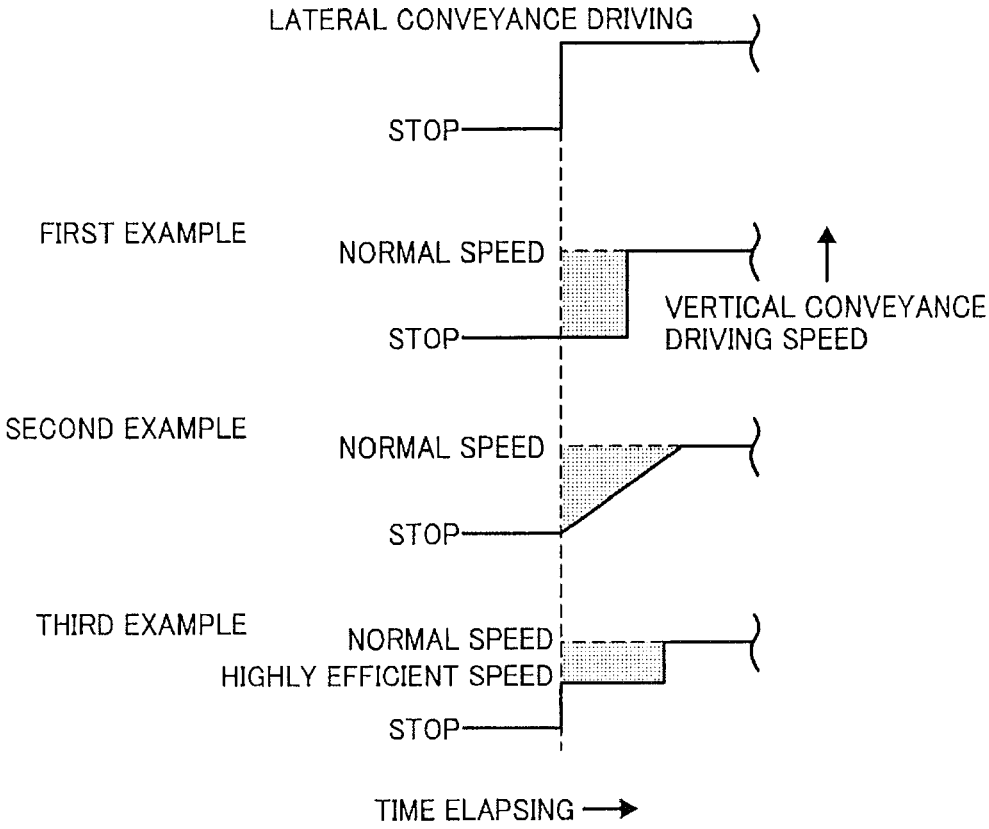
FIG. 4 illustrates an exemplary sequence of operations of the lateral and vertical conveyance according to another embodiment of the present invention.

An exemplary sequence of lateral and vertical driving is described with reference to FIG. 4. Accordingly, the vertical conveyance member 8 is driven by a driving mechanism for the lateral conveyance path 1 via the driving force accumulation mechanism 12 in this driving system, the driving force is accumulated into the driving force accumulation mechanism 12 during the prescribed delay time. Thus, the operation of the prescribed delay can be realized at low cost.

Now, a sixth embodiment is described. This embodiment is based on the first to fifth embodiments, and wherein when a door of an image forming apparatus is unexpectedly open during the prescribed delay, the operation during the prescribed delay is forcibly interrupted or stopped.

According to this embodiment, even though a user or the like opens the door of the apparatus during the delay time operation, an accident possibly caused by erroneously contacting an operation section can be avoided by forcibly interrupting or stopping the operation during the prescribed delay. When such a driving force accumulation mechanism 12 is employed, since it can't be stopped simply by turning off an electric system different from a situation in which a motor is used for driving the vertical conveyance belt 8, a safeguard, such as a brake, a stopper, etc., is needed. Then, a prescribed safeguard can be arranged in an image forming apparatus or an all-in-one unit or the like.

Now, a seventh embodiment is described. This embodiment is based on the first to sixth embodiments, and further employing low melting point toner.

Specifically, the low melting point toner hardly sticks and is not aggregated on the vertical conveyance member 8. Further, the used toner can credibly be conveyed even if the vertical conveyance path is not used for a long time period.

Now, a ninth embodiment is described. This embodiment is based on the first to sixth embodiments, and further employs polymerization toner.

Specifically, the polymerization toner hardly sticks and is not aggregated on the vertical conveyance member 8. Further, the used toner can credibly be conveyed even if the vertical conveyance path is not used for a long time period.

Now, a tenth embodiment is described. This embodiment is based on the first to ninth embodiments and further includes a process cartridge. Specifically, the process cartridge preferably includes the lateral and vertical conveyance paths 1 and 4 as mentioned in the above-mentioned embodiment to seal the toner. The process cartridge preferably receives transmission of driving force or the like from an outside.

Figure 5:
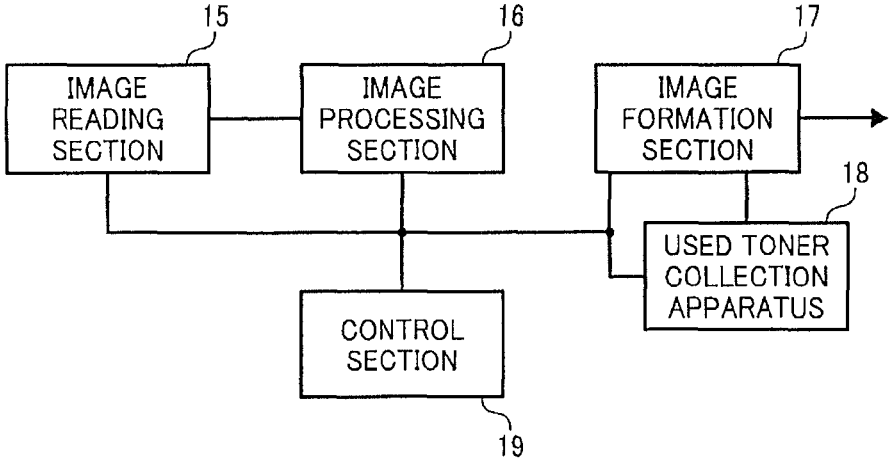
FIG. 5 illustrates a block chart showing an exemplary image forming apparatus according to one embodiment of the present invention.

Now, a schematic configuration of an image forming apparatus according to an eleventh embodiment is described with reference to FIG. 5. As shown, 15 denotes an image reading section including a scanner for reading an original document. 16 denotes an image processing section for processing image data read by the scanner. 17 denotes an image forming section for exposing a photo-conductive member and forming a latent image in accordance with the image data processed by the image reading section. The image forming section 17 adheres toner to the latent image and outputs a print. 18 denotes a used toner collection device one of the first to ninth embodiments. The used toner collecting device 18 can be integrally formed with the process cartridge, and is detachable from an image forming apparatus. 19 denotes a control section employing a computer for general control use.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A used toner conveyance device, comprising:

a lateral conveyance path by which the used toner is conveyed along at least a portion of the lateral conveyance path substantially in a horizontal direction;

a vertical conveyance path by which the used toner received from the lateral conveyance path is upwardly conveyed along at least a portion of the vertical conveyance path, said vertical conveyance path transferring the used toner to one of a collection space and a next conveyance path; and a driving force accumulation mechanism configured to accumulate a driving force generated by a driving device that engages the lateral conveyance path, wherein the driving force accumulated by the driving force accumulation mechanism is transmitted to a driving device that drives the vertical conveyance path during the prescribed delay time, wherein after a conveyance operation by the lateral conveyance path associated with an image forming operation stops, said vertical conveyance path stops its conveying operation when a prescribed delay time has elapsed, wherein said used toner can be conveyed during the prescribed delay time from a used toner transfer section, at which the used toner is transferred from the lateral conveyance path to the vertical conveyance path, to another used toner transfer section, at which the used toner is transferred from the vertical conveyance path to one of the collection space and the next conveyance path, and wherein a conveyance speed for the used toner of the vertical conveyance path gradually increases after starting up, while the driving force generated by the driving device that engages the lateral conveyance path, is accumulated at the same time in the driving force accumulation mechanism.

2. The used toner conveyance device as claimed in claim 1, wherein a conveyance speed at which the used toner is conveyed along the vertical conveyance path is slower during the prescribed delay time than at a time of conveyance other than during the prescribed delay time.

3. The used toner conveyance device as claimed in claim 1, wherein the toner is polymerized toner.

4. A processing cartridge including the used toner conveyance device as claimed in claim 1.

5. An image forming apparatus including the used toner conveyance device as claimed in claim 1.

* * * * *